US010815639B2

(12) United States Patent
Altstadt et al.

(10) Patent No.: US 10,815,639 B2
(45) Date of Patent: Oct. 27, 2020

(54) BUCKET CLEANOUT

(71) Applicant: Clark Equipment Company, West Fargo, ND (US)

(72) Inventors: David Altstadt, Gwinner, ND (US); Lucas Gossen, Orono, MN (US); Jesse Laugen, Roseau, MN (US); Kenneth Loepp, Sahuarita, AZ (US); Doran Hirschkorn, Bismarck, ND (US); Riley Fritz, Maple Grove, MN (US); Benjamin Schanilec, Forest River, ND (US); Chase Redmond, Alexandria, MN (US); Joel Ende, Rogers, MN (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/123,667

(22) Filed: Sep. 6, 2018

(65) Prior Publication Data

US 2019/0071840 A1 Mar. 7, 2019

Related U.S. Application Data

(60) Provisional application No. 62/554,722, filed on Sep. 6, 2017.

(51) Int. Cl.

| | |
|---|---|
| ***E02F 3/40*** | (2006.01) |
| ***E02F 3/407*** | (2006.01) |
| ***E02F 3/32*** | (2006.01) |

(52) U.S. Cl.

CPC ..... *E02F 3/407* (2013.01); *E02F 3/325* (2013.01)

(58) Field of Classification Search

CPC ..... E02F 3/407; E02F 3/656

USPC ..... 414/725

See application file for complete search history.

(56) References Cited

U.S. PATENT DOCUMENTS

| | | | |
|---|---|---|---|
| 1,653,905 | A | 12/1927 | Harrison |
| 2,683,542 | A | 7/1954 | Baker |
| 2,719,641 | A | 10/1955 | Pilch |
| 2,772,011 | A | 11/1956 | Ferwerda |
| 2,812,872 | A | 11/1957 | Perkins et al. |
| 2,853,201 | A | 9/1958 | Davidson et al. |
| 2,858,035 | A | 10/1958 | Mettetal, Jr. |
| 2,864,518 | A | 12/1958 | Beyerstedt |
| 3,035,724 | A | 5/1962 | Clark et al. |
| 3,092,920 | A | 6/1963 | Benno |
| 3,140,001 | A | 7/1964 | Strader |
| 3,195,747 | A | 7/1965 | Kashergen |
| 3,229,835 | A | 1/1966 | Watts |
| 3,268,100 | A | 8/1966 | Drouillard |
| 3,349,934 | A | 10/1967 | Moyer et al. |

(Continued)

OTHER PUBLICATIONS

International Search Report and Written Opinion dated Nov. 22, 2018 for International Application No. PCT/US2018/049724 filed Sep. 6, 2018, 12 pages.

*Primary Examiner* — Ronald P Jarrett

(74) *Attorney, Agent, or Firm* — John Veldhuis-Kroeze; Westman, Champlin & Koehler, P.A.

(57) ABSTRACT

Disclosed are excavators or other power machines having a lift arm structure with a bucket coupled to an arm to pick up material during a digging or scooping operation, and a bucket cleanout devices to aid in removal of material from the bucket. The bucket cleanout devices include components which are rotatably coupled to a support structure, such as the arm, an implement carrier and/or the bucket and configured to aid in removal of material during a material dumping movement of the bucket.

17 Claims, 19 Drawing Sheets

(56) References Cited

U.S. PATENT DOCUMENTS

| | | | |
|---|---|---|---|
| 3,380,904 | A | 4/1968 | Leese |
| 3,407,952 | A | 10/1968 | Gardner |
| 3,421,236 | A | 1/1969 | Moyer |
| 3,426,928 | A | 2/1969 | Campbell |
| 3,433,377 | A | 3/1969 | Campbell |
| 3,484,010 | A | 12/1969 | Campbell |
| 3,523,621 | A | 8/1970 | Anderson et al. |
| 3,539,069 | A | 11/1970 | Allen et al. |
| 3,543,960 | A | 12/1970 | Wagner |
| 3,581,924 | A | 6/1971 | Marz |
| 3,750,816 | A | 8/1973 | Becker |
| 3,837,516 | A | 9/1974 | Meyer |
| 3,872,986 | A | 3/1975 | Campbell |
| 4,030,626 | A | 6/1977 | Durham |
| 4,032,015 | A | 6/1977 | Hemphill |
| 4,349,308 | A | 9/1982 | Buckstead et al. |
| 5,702,227 | A | 12/1997 | Berg |
| 5,940,996 | A | 8/1999 | Cummings |
| 6,347,464 | B1 | 2/2002 | Klager |
| 6,658,769 | B2 | 12/2003 | Klager |
| 7,260,903 | B2 | 8/2007 | Arp |
| 7,631,446 | B1 | 12/2009 | Davis |
| 8,857,080 | B1 | 10/2014 | Sutter |
| 2013/0216347 | A1 | 8/2013 | Breuer et al. |

BUCKET CLEANOUT

CROSS-REFERENCE TO RELATED APPLICATION

This application claims the benefit of U.S. Provisional Application No. 62/554,722, filed Sep. 6, 2017.

BACKGROUND

This disclosure is directed toward power machines. More particularly, this disclosure is directed to a bucket cleanout mechanism for power machines, such as excavators, with a bucket implement attached to an arm.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

In excavators and work vehicles having a lift arm structure to which a bucket is attached for digging or scooping material, after moving the excavator and/or the lift arm structure to position the bucket at a location where material is to be dumped, dumping of the bucket typically involves using an implement or tilt actuator coupled between the lift arm structure and the bucket or an implement carrier to roll back the bucket. However, material within the bucket often does not easily exit, and an operator may have to move the arm structure when attempting to shake the material from the bucket. This can be a time-consuming process that slows work and requires skill of the operator to implement. Failure to remove the material from the bucket during a dump operation allows less material to be moved per scoop and dump operation cycle, which also slows work and increases costs to complete a task.

The discussion above is merely provided for general background information and is not intended to be used as an aid in determining the scope of the claimed subject matter.

SUMMARY

Disclosed are excavators or other power machines having a lift arm structure with a bucket coupled to an arm to pick up material during a digging or scooping operation. The excavators also have a bucket cleanout mechanism rotatably coupled to a support structure, such as the arm, and implement carrier and/or the bucket, and configured to aid in removal of material during a material dumping movement of the bucket. In some exemplary embodiments, the bucket cleanout mechanism includes a bucket cleanout cross-member positioned within the bucket, and extending at least partially across the width of the bucket. The bucket cleanout mechanism can be biased by a bias mechanism toward a first position of the cleanout cross-member within the bucket, though a bias mechanism is not required in some embodiments. A linking mechanism coupled between the cleanout mechanism and a second support structure, such as the arm or a linkage coupled to the arm, can be included to to move the cleanout cross-member from the first position to a second position to aid in removal of material from the bucket. Disclosed embodiments also include bucket cleanout mechanisms and corresponding methods of aiding in the removal of material from a bucket.

In some exemplary embodiments, a bucket cleanout apparatus (420; 520) is provided which is configured to aid in removal of material from a bucket (405; 505) of a power machine (100; 200), the bucket cleanout apparatus includes a cleanout arm assembly (410; 510) configured to be at least partially positioned within the bucket, and a pivot attachment mechanism (440; 540) configured to pivotally mount the cleanout arm assembly to a first support structure such that the cleanout arm assembly pivots to move within the bucket. A mount (450; 550) of the bucket cleanout apparatus is coupled to the cleanout arm assembly and is configured to couple the cleanout arm assembly to a second support structure. In coupling the arm assembly to the second support structure, the cleanout arm assembly is caused to move relative to the bucket between a first position and a second position, when the bucket is moved in a roll back movement relative to the arm of the power machine, to thereby aid in removal of material from the bucket.

In some exemplary embodiments, the cleanout arm assembly (410) comprises a first arm (425; 525), a second arm (430; 530), and a cross-member (435; 535) extending between the first arm and the second arm. Also, in some embodiments, at least portions of the first arm (425; 525) and the second arm (430; 530) of the cleanout arm assembly (410; 510) are configured to be respectively disposed adjacent to opposite side walls (474, 476; 574; 576) of the bucket (405; 505), with the cross-member (435; 535) of the cleanout arm assembly (410; 510) extending between distal ends of the first arm (425; 525) and the second arm (430; 530) substantially across a width of the bucket.

In some exemplary embodiments, each of the first arm (425; 525) and the second arm (430; 530) of the cleanout arm assembly (410; 510) further comprises a first arm portion (426, 431; 526, 531), a second arm portion (427, 432; 527, 532).

In some exemplary embodiments, each of the first arm (425) and the second arm (430) include a pivot attachment feature (428) positioned between the first and second arm portions. The pivot attachment features of the first and second arms are configured to pivotally mount the cleanout arm assembly to the bucket with the pivot attachment mechanism (440).

In some exemplary embodiments, the attachment mechanism (440) comprises first and second spring-loaded bracket assemblies (442; 444) each configured to be positioned on sides of an implement carrier (472) to which the bucket is attached and to apply bias forces to the cleanout arm assembly.

In some exemplary embodiments, the mount (450) further comprises a first linking mechanism (456) configured to couple the second arm portion (427) of the first arm (425) to the arm (434) of the power machine, and a second linking mechanism (458) configured to couple the second arm portion (432) of the second arm (430) to the arm (434) of the power machine. In a first bucket position the first and second linking mechanisms (456; 458) are not under tension and the first and second spring loaded bracket assemblies (442; 444) maintain the cleanout arm assembly (410) in the first position relative to the bucket (405). Rollback movement of the bucket (405) toward a second bucket position places the first and second linking mechanisms (456; 458) under tension such that further roll back movement of the bucket causes the first and second linking mechanisms (456; 458) to apply counteracting forces to the cleanout arm assembly (410) to overcome the bias forces applied by the first and second spring-loaded bracket assemblies (442; 444) and thereby move the cleanout arm assembly (410) to the second position relative to the bucket (405) to aid in cleaning material from the bucket.

In some embodiments, distal ends of the second arm portions (527; 532) of each of the first and second arms are pivotally attached to the first support structure by the pivot attachment mechanism (540). Further, in some embodiments the first arm portions (526; 531) of each of the first and second arms (525; 530) of the cleanout arm assembly (510) are configured and shaped to be respectively disposed in the bucket (505) adjacent to opposite side walls (574; 576) of the bucket. In some embodiments, a middle support member (533) extends between the first and second arms (525; 530) and couples the first and second arm portions of each arm.

In some embodiments, the mount (550) further comprises a first linking mechanism (556) configured to couple the second arm portion (527) of the first arm (525) to the second support structure of the power machine. In a first bucket position the first linking mechanism (556) is not under tension, but rollback movement of the bucket (505) toward a second bucket position places the first linking mechanism (556) under tension such that further roll back movement of the bucket causes the first linking mechanism (556) to move the cleanout arm assembly (510) to the second position relative to the bucket (505).

In other exemplary embodiments, power machines including a power machine arm (434; 534), a bucket (405; 505), an implement carrier (472) coupling the bucket to the power machine arm, and components of the bucket cleanout apparatus (420; 520) are provided.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments include power machines, such as excavators, having a bucket cleanout mechanism to aid in the removal of material from a bucket during a bucking dumping movement. Disclosed embodiments also include bucket cleanout mechanisms and methods. In exemplary embodiments, the bucket cleanout mechanisms are rotatably coupled to the arm and/or bucket, and include a bucket cleanout cross-member positioned within the bucket, and extending at least partially across the width of the bucket. In some embodiments, a bias mechanism, such as a torsion mount, biases the bucket cleanout mechanism toward a first position of the cleanout cross-member within the bucket for normal operation. During a material dumping operation, such as by rolling back the bucket, the bucket cleanout mechanism is configured to overcome the bias forces to move the cleanout cross-member from the first position to a second position to aid in removal of material from the bucket.

Figure 2:
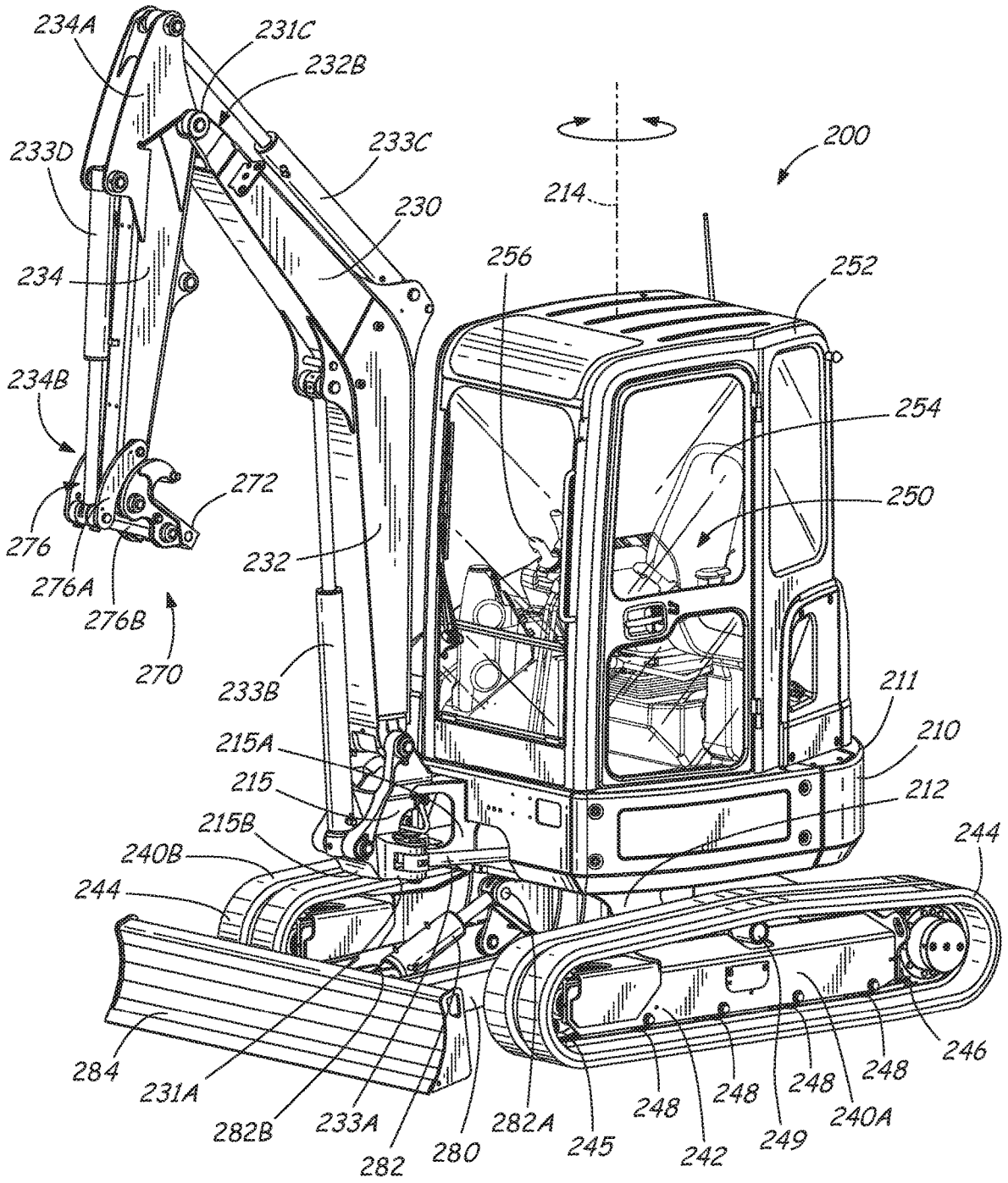
FIG. 2 is a front left perspective view of a representative power machine in the form of an excavator on which the disclosed embodiments can be practiced.
Figure 3:
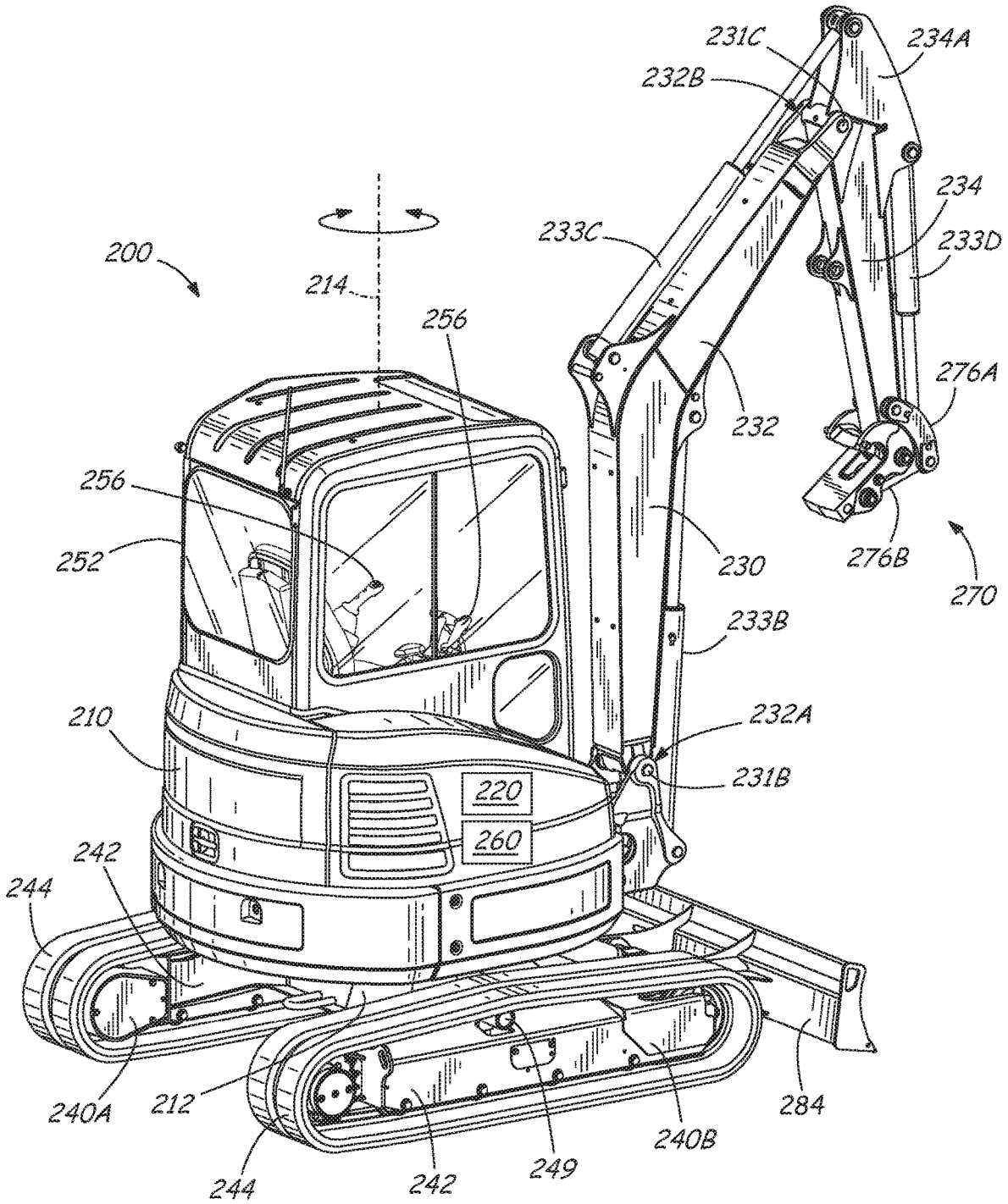
FIG. 3 is a rear right perspective view of the excavator of FIG. 2.

These concepts can be practiced on various power machines, as will be described below. A representative power machine on which the embodiments can be practiced is illustrated in diagram form in FIG. 1 and examples of such a power machine are illustrated in FIGS. 2-3 and described below before any bucket cleanout embodiments are disclosed. For the sake of brevity, only a few power machines are discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
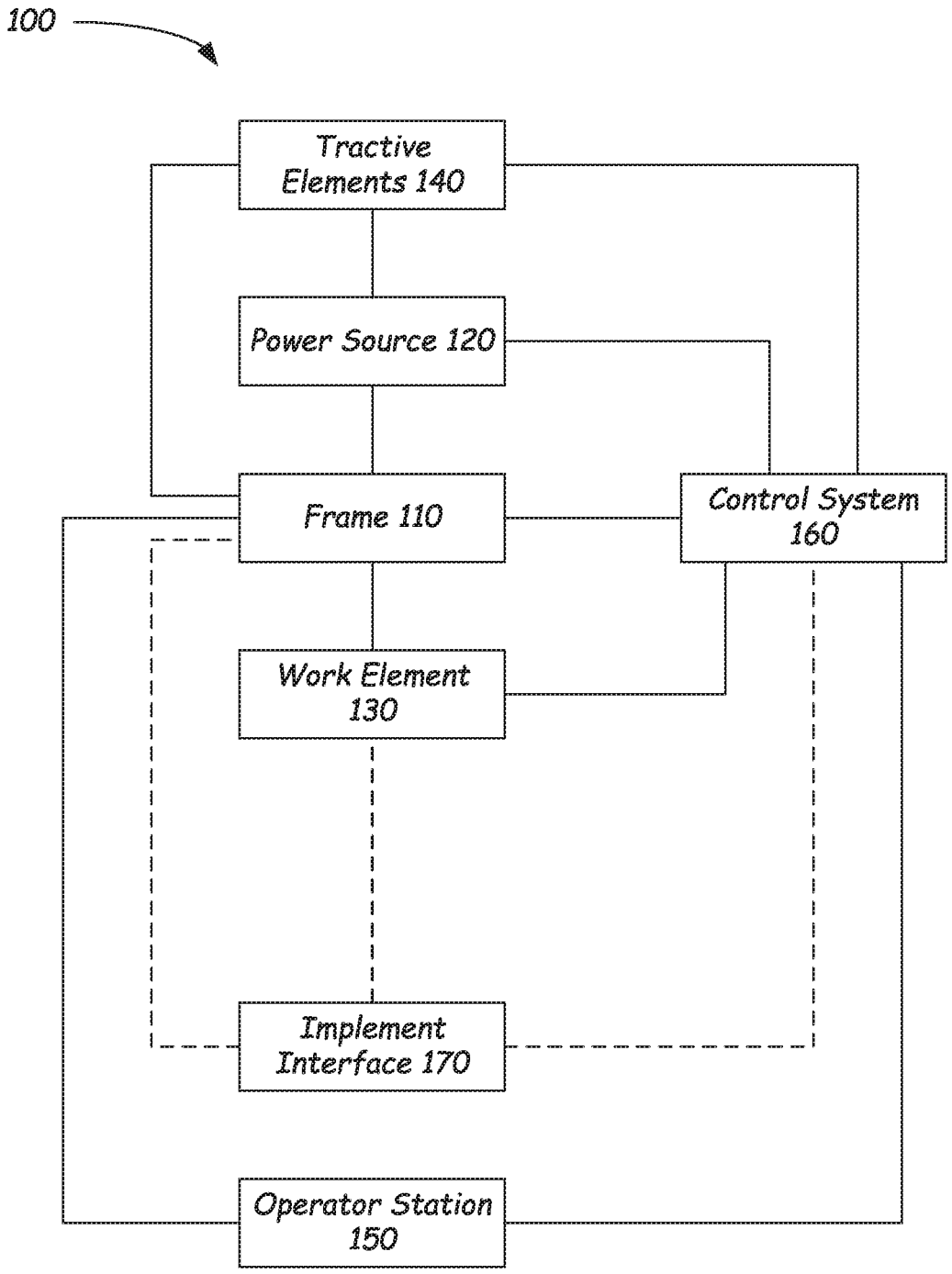
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote-control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion, known generally as a boom 232 and a second portion known as an arm or a dipper 234. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and prevent the track from rubbing on track frame 242.

A second, or lower lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
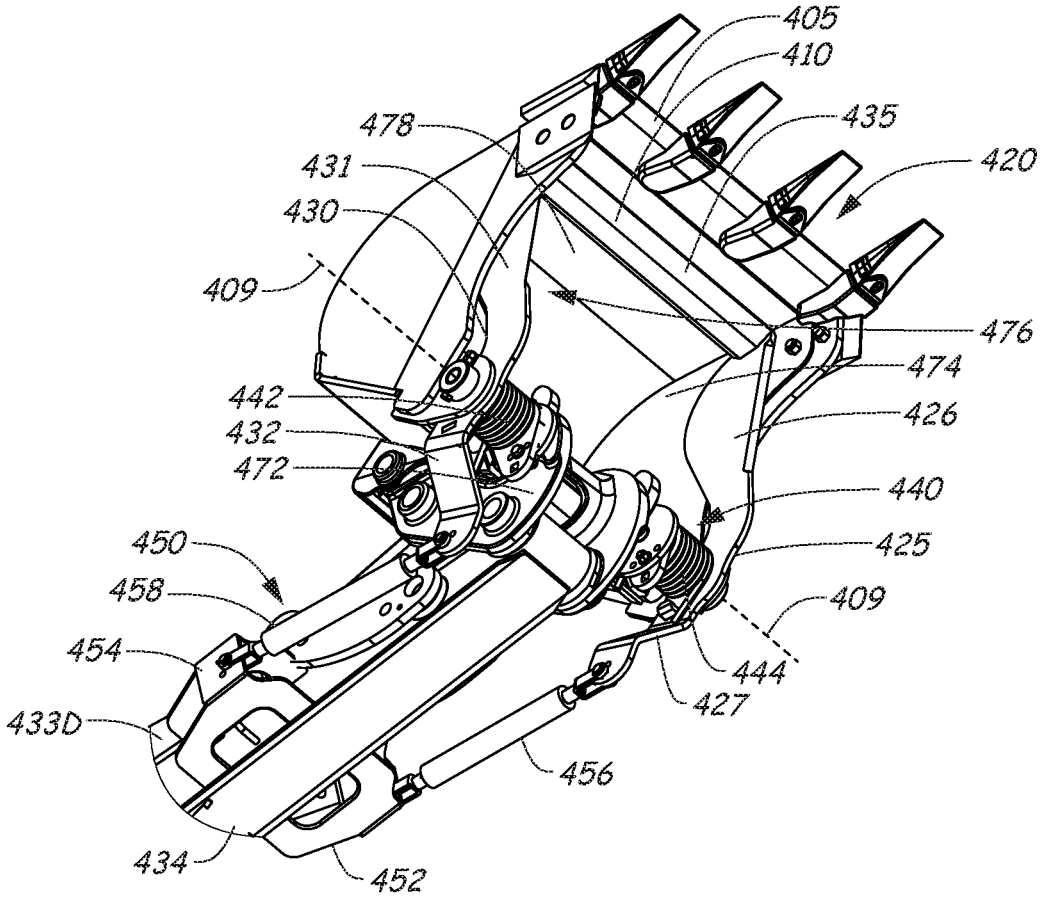
FIG. 4 is a diagrammatic perspective view of an excavator arm and bucket including a bucket cleanout device in accordance with exemplary embodiments.

FIG. 4 illustrates an arm or dipper arm 434 with an implement in the form of a bucket 405 and a cleanout mechanism or device 420 for removing foreign material (i.e. dirt and debris) that may be lodged in the bucket during a digging cycle according to one illustrative embodiment. The arm 434 is an embodiment of arm 234 shown in FIGS. 2 and 3 for an exemplary power machine. Bucket 405 is rotatably mounted to arm 434 via an implement carrier 472. Pivotal movement of bucket 405 about arm 434 is controlled by an implement carrier actuator 433D, which can be a hydraulic cylinder type actuator such as actuator 233D shown in FIGS. 2 and 3, that is coupled between arm 434 and the implement carrier 472, or between arm 434 and bucket 405. Typically, to scoop material into bucket 405, actuator 433D is extended to rotate the bucket forward. To dump the material from bucket 405, actuator 433D is retracted to rotate or roll the bucket backward. Scooping and dumping actions also commonly include control of the arm structure of the power machine.

Bucket cleanout device 420 is provided to aid in the removal of material from bucket 405 during a material dumping movement of the bucket. Bucket cleanout device 420 is shown attached to the bucket 405 in FIG. 4 and separate from the bucket in FIGS. 12-13. Bucket cleanout device 420 includes a cleanout arm assembly 410 that is partially positioned within the bucket 405. The bucket cleanout device 420 also includes a pivot attachment mechanism 440 through which the cleanout arm assembly 410 is pivotally mounted to a first support structure, such as bracket 452. In one embodiment, the pivot attachment mechanism 440 in the embodiment shown in FIG. 4 includes a first spring-loaded bracket assembly 442 and a second spring-loaded bracket assembly 444 positioned on either side of the implement carrier 472. The arms 425 and 430 as well as the cross-member 435 are capable of pivoting with respect to the bucket 405 about the attachment mechanism and specifically about axis 409.

The bucket cleanout device 420 also includes a mount 450 configured to couple the cleanout arm assembly 410 to a second support structure, such as bracket 454 of the power machine. The cleanout arm assembly 410 is operably coupled to the mount 450 and via the mount is coupled to the second support structure. As will be discussed below, the connection between the lift arm 434 (or other second support structure) and the cleanout arm assembly 410 will cause the cleanout arm assembly to move relative to the bucket 405 between the first position and the second position when the bucket 405 moved during normal operation of the bucket. The first and second positions of the cleanout arm assembly will be discussed in more detail below.

In the illustrative embodiment, the cleanout arm assembly 410 includes first and second cleanout arms 425 and 430 disposed adjacent to opposite side walls 474 and 476 of bucket 405. A cleanout cross-member 435 extends between distal ends of arms 425 and 430 and is attached to each or integrally formed with the arms such that cross-member 435 spans the width of the bucket 405. As mentioned above and will be discussed below, the cleanout arms 425 and 430 and the cross-member 435 are configured to remove debris that is collected in a bucket during normal operation of the bucket.

Figure 12:
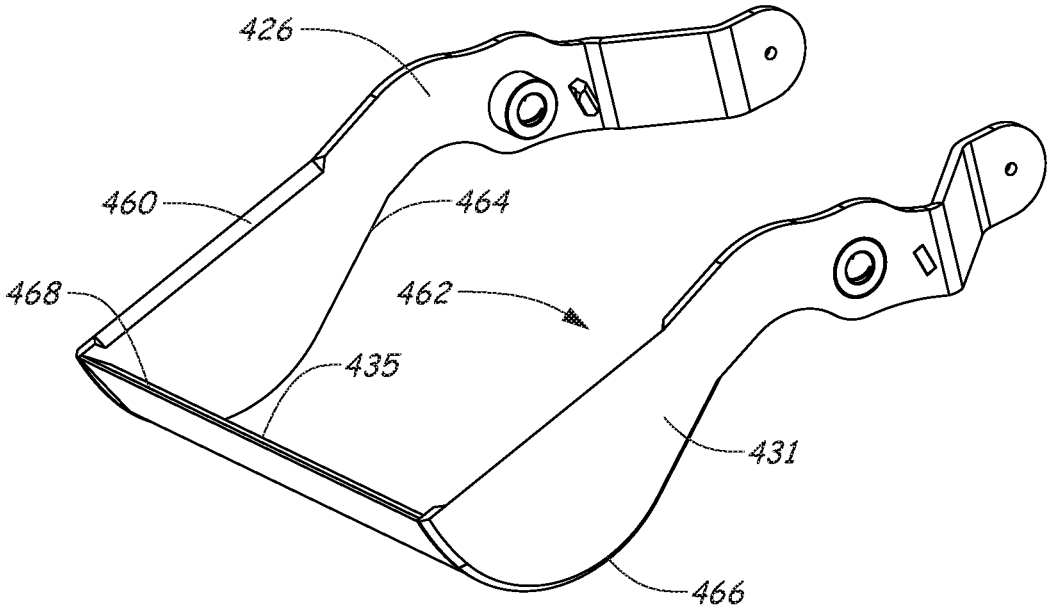
FIGS. 12-13 are perspective views of the cleanout mechanism of FIG. 4.
Figure 13:
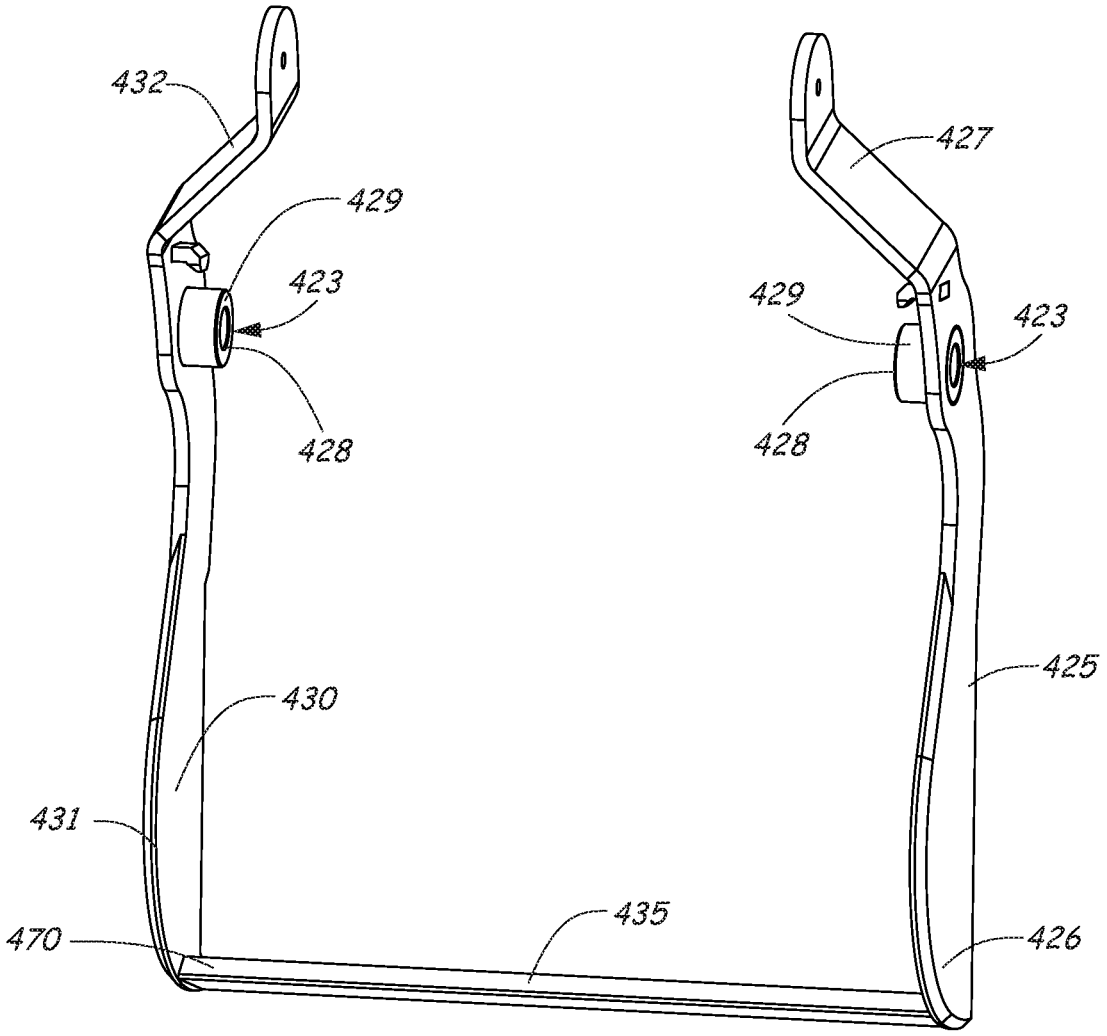

Each of the arms 425 and 430 has a first arm segment or portion 426 and 431, respectively, and a second arm segment or portion 427 and 432, respectively, with a pivot attachment feature 428 positioned between the first and second arm portions of each, the pivot attachment feature delineating the first and second arm portions. As is best seen in FIGS. 12-13, the pivot attachment feature 428 on each arm 425 and 430 includes an aperture 423 that extends through the respective arm. A bushing 429 is illustratively included in each of the pivot attachment features 428 to provide additional strength at the pivot attachment feature 428 and the aperture 423 extends through the bushing. The arm portions 426, 427, 431 and 432 can have different shapes and configurations in various embodiments. For example, the arm portions 426 and 431 are advantageously shaped and configured to engage the inside surfaces of the bucket 405. In addition, arm portions 427 and 432 include an inward taper or angle to reduce a width between arm portions 427 and 432 as compared to a width between arm portions 426 and 431. This facilitates a more convenient coupling of the arms 425 and 430 to the lift arm 434. Arm portions 426 and 431 are longer than arm portions 427 and 432 such that movement of the shorter arm portions and the resulting pivotal movement of arms 425 and 430 about an axis (i.e., axis 409) that extends through the pivot attachment features 428 on each arm, cause a greater amount of movement of longer arm portions 426 and 431, as well as of cross-member 435.

The arm portions 426 and 431 each have a curved profile 464 and 466, respectively, that is designed to conform to a curved interior surface of edges of side walls 474 and 476 of bucket 405 such that when the arms move toward the first position, the curved profile 464 and 466 moves toward the edges of the side walls (i.e. where the side wall intersects with a main surface—sometimes referred to as a wrap-around—478) so as to engage and remove some debris from substantially all of the side wall surfaces. In addition, the arm portions 426 and 431 prevent debris from building up on the side walls near the edges because curved surfaces 464 and 466 match contours of the side walls when the arm portions 426 and 431 are in the first position, they are covering the edges of the side walls during a digging operation. The arm portions 426 and 431 also includes tapered edges 460 and 462 on opposing edges of the curved profiles 464 and 466 provided to engage and remove debris as the arms 425 and 430 move from the first position to the second position. The curved profile sections 464 and 466 can also be tapered as is shown in FIG. 13. It should be noted here that the arms move from the first to the second position during a dumping option and is the primary movement for scraping material off the walls of the bucket 405, with movement from the second position to the first position as the bucket is returned to a digging position. The tapers on the curved profile sections 464 and 466 serve to reduce interaction between any remaining debris and the arms as they move toward the first position.

Like the arms, in some embodiments, the cross-member 435 has features to assist the removal of dirt and debris from the main surface 478 of the bucket 405. The cross-member 435 includes tapered edges 468 and 470, which allows the cross-member 435 to scrape dirt and debris from the main surface when moving from the first position to the second position and from the second position to the first position. As is the case with the tapered features on the edges 464 and 466, the tapered edge 470 does not typically scrape much material when moving from the second position to the first position, and instead mostly reduces any interference between residue on the main surface 478 of the bucket and the cross-member 435 as it moves from the second position to the first position. With a reduced interference, the arm assembly is more easily returned to the first position under the influence of the spring-loaded bracket assemblies 442 and 444.

Figure 5:
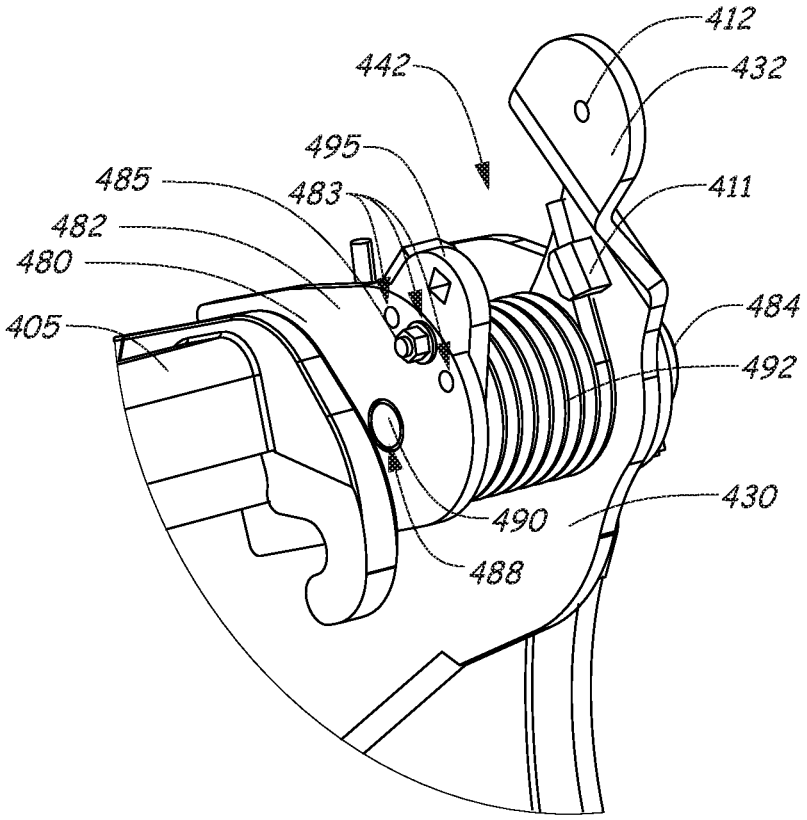
FIG. 5 is a diagrammatic perspective view of an embodiment of a coupling mechanism of the bucket cleanout device including a bias mechanism configured to bias the cleanout device into a first position.

Each of the first spring-loaded bracket and second spring-loaded bracket assemblies 442 and 444 of the embodiment illustrated in FIG. 4 are substantially similar. In some embodiments, they are mirror images of each other, which means that some of the components might not be exactly identical (for example, a torsional cone, illustrated in FIG. 15 and discussed below has some mirrored features rendering the part not exactly identical). FIG. 5 illustrates first spring-loaded assembly 442 mounted to bucket 405. Again, as this discussion of first spring-loaded assembly 442 and components of the first spring-loaded assembly continues, it should be understood that the second spring-loaded assembly 444 and components thereof can be substantially similar or identical to those of the first spring-loaded assembly.

Figure 14:
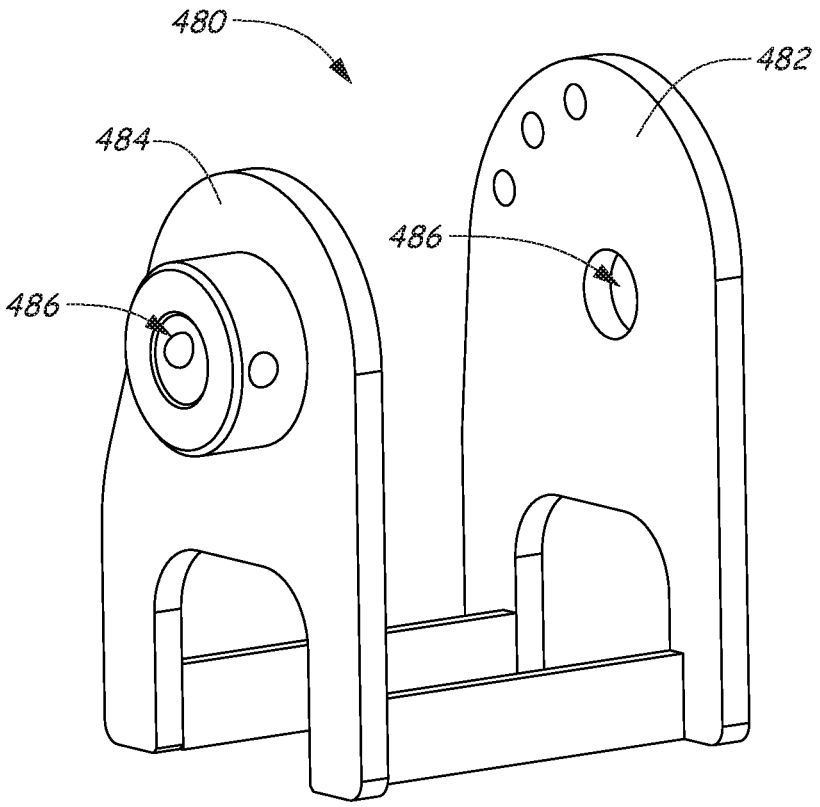
FIG. 14 is a perspective view of a mount for use in the coupling mechanism of FIG. 5.
Figure 15:
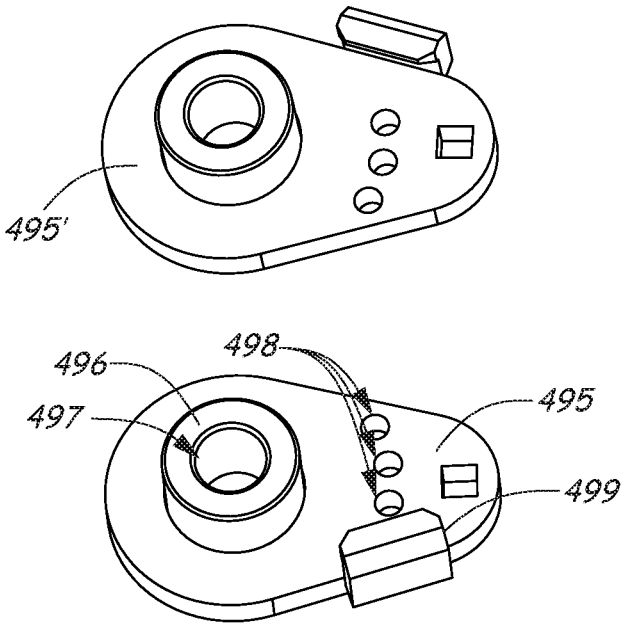
FIG. 15 illustrates a pair of torsional cones for use in the coupling mechanism of FIG. 5.

First spring-loaded assembly 442 includes a mount 480 (best shown in FIG. 14) that is fixed such as by welding to the bucket 405. Mount 480 includes a pair of towers 482 and 484. Each of the towers 482 and 484 have an aperture 486 and 488, respectively. The arm 430 is positioned between the towers such that a pin 490 extends through apertures 486 and 488 as well as aperture 423 to secure the arm 430 to the mount 480. In addition, a torsional spring 492 is operably coupled to the mount 480 and the arm 430. As shown in FIG. 5, the spring 492 is coupled to the arm 430 via a clip or bracket 411. The spring 492 is operably coupled to the mount 480 via an adjustable torsional cone 495, which itself is coupled to the mount 480 via a fastener. Torsional cone 495, as shown in FIG. 15, is one example of a structure that can be employed to couple the spring 492. Torsional cone 495 includes a cylindrical collar 496 that is sized to fit within the spring 492 to align the spring 492. An aperture 497 extends through the collar 496 to receive the pin 490. The adjustable torsional cone 495 also includes a plurality of apertures 498 that can be aligned with apertures 483 on mount 480. A fastener 485 secures the torsional cone 492 to the mount 480. The plurality of apertures on each of the mount 480 and the torsional cone 495 allows the torsional cone 495 to be adjusted relative to the mount 480. The torsional cone 495 also includes a catch 499 against which an end of the spring 492 can be captured. Thus, by adjusting the torsional cone 495 relative to mount 480, the tension on spring 492 can be adjusted. FIG. 15 also includes a torsional cone 495', which is similar to but substantially a mirror image of torsional cone 495. Torsional cone 495' is configured be used with bracket assembly 444.

Figure 9:
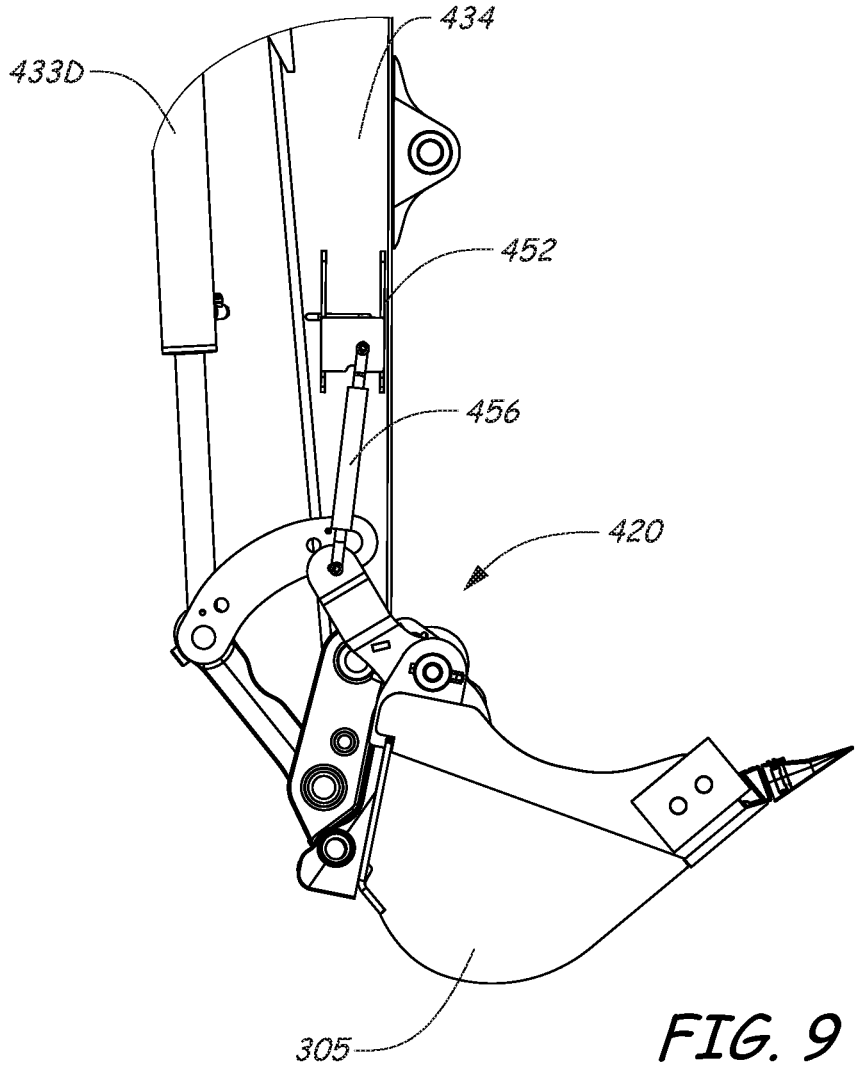
FIG. 9 is a side perspective view of another embodiment of the bucket cleanout device including an alternative type of linking mechanism from that shown in FIG. 4.
Figure 10:
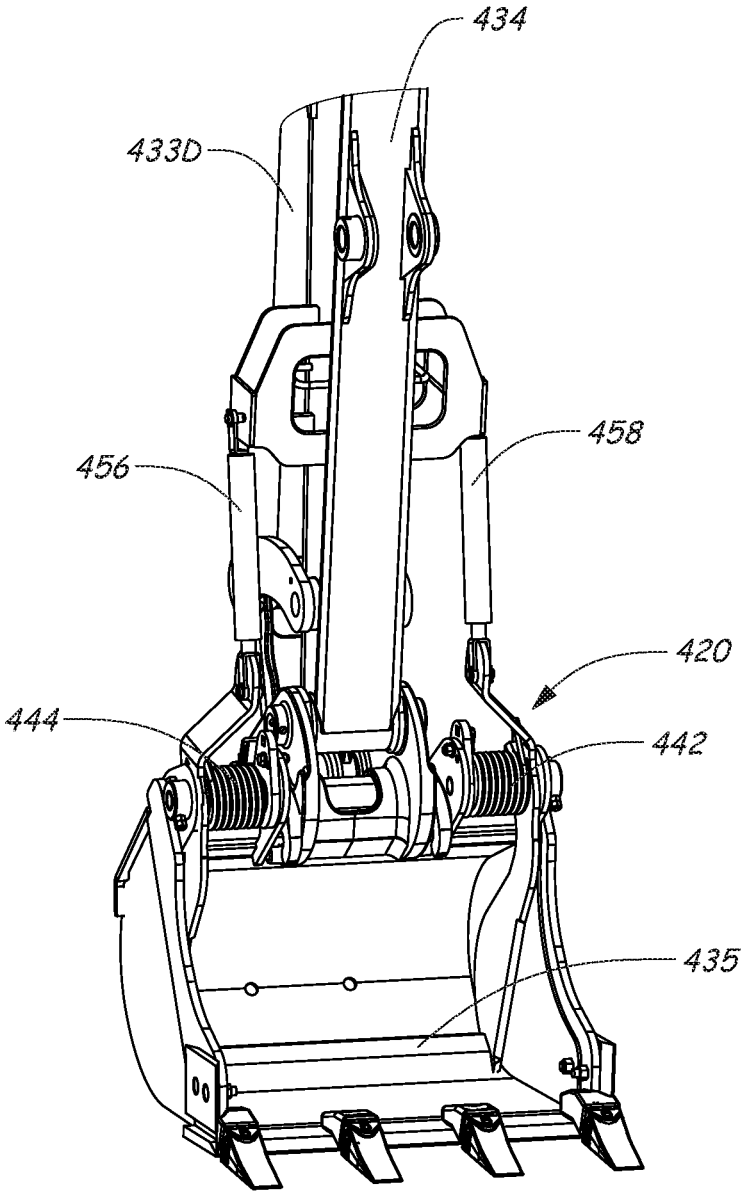
FIG. 10 is a diagrammatic perspective view of the excavator arm, bucket and bucket cleanout device shown in FIG. 9, with the bucket cleanout device in the first or biased position within the bucket.
Figure 11:
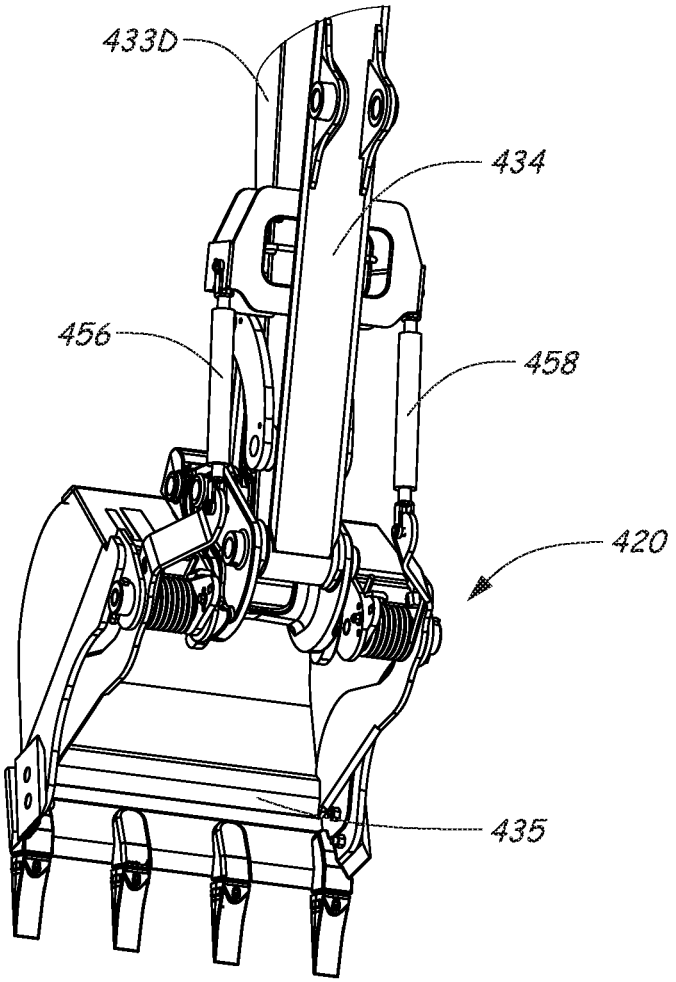
FIG. 11 is a diagrammatic perspective view of the excavator arm, bucket and bucket cleanout device shown in FIG. 9, with the bucket cleanout device moved to the second position to aid in removal of material from the bucket.

The mount 450 of the bucket cleanout device 420 includes a pair of brackets 452 and 454 mounted on arm 434. While considered components of the cleanout device 420 in some embodiments, in other embodiments, brackets 452 and 454 are considered components of arm 434 and are used by cleanout device 420. Brackets 452 and 454 can be welded to arm 434, or attached using bolts, rivets, or other fasteners or fastening techniques. Cleanout device 420 further includes linking mechanisms 456 and 458, with linking mechanism 456 coupled between second arm portion 432 (e.g., using aperture 412 shown in FIG. 5) and bracket 452, and with linking mechanism 458 coupled between second arm portion 427 and bracket 454. Linking mechanisms 456 and 458 can be cables (as shown in FIG. 4), chains (as shown in FIGS. 9-11), or other types of linkages or linking mechanisms.

Figure 6:
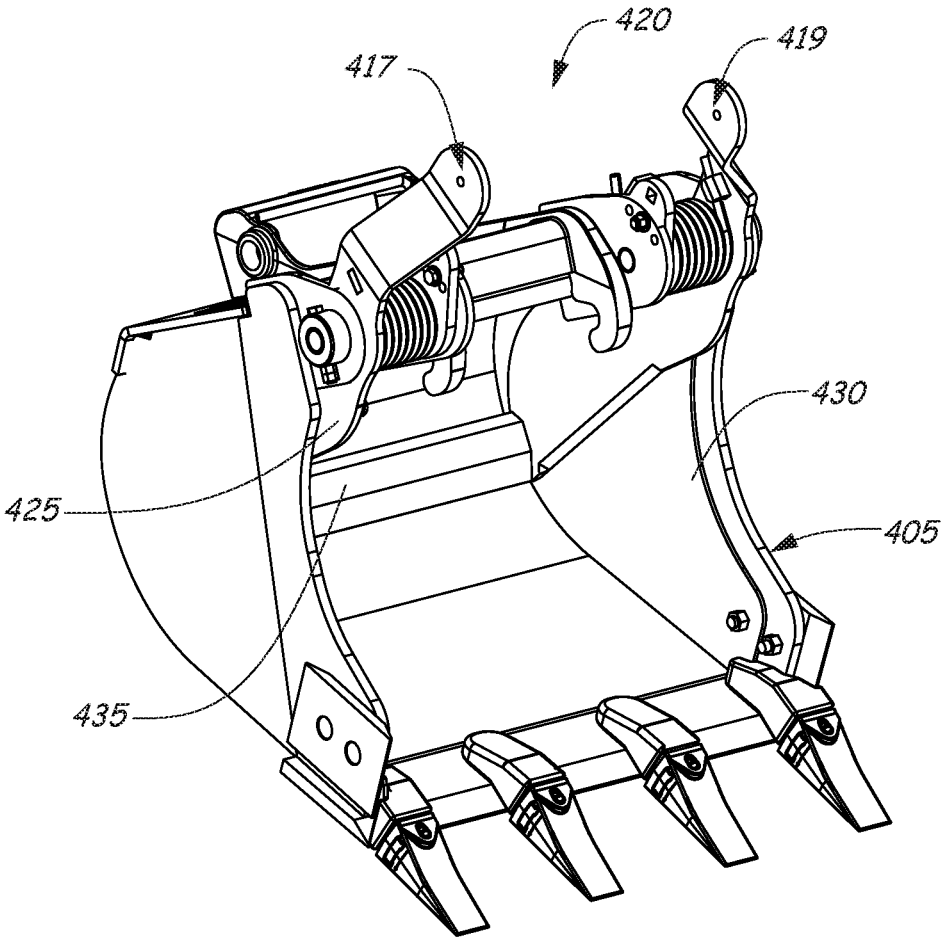
FIG. 6 is a diagrammatic perspective view of the bucket and bucket cleanout device shown in FIG. 4, with the bucket cleanout device biased into the first position within the bucket.
Figure 7:
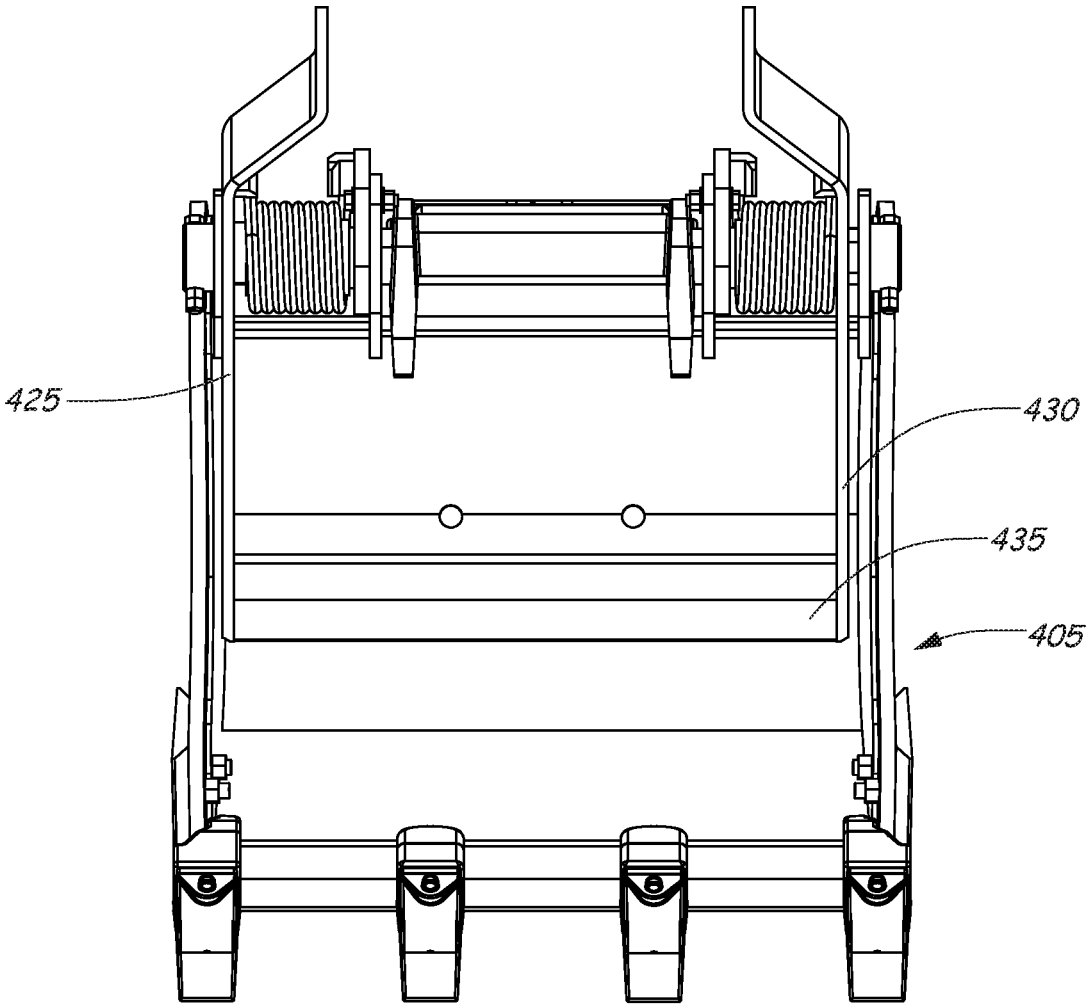
FIGS. 7 and 8 are front and perspective views, respectively, of the bucket and bucket cleanout device shown in FIG. 4, with the bucket cleanout device moved to a second position in FIG. 8, which aids in removing material from the bucket.
Figure 8:
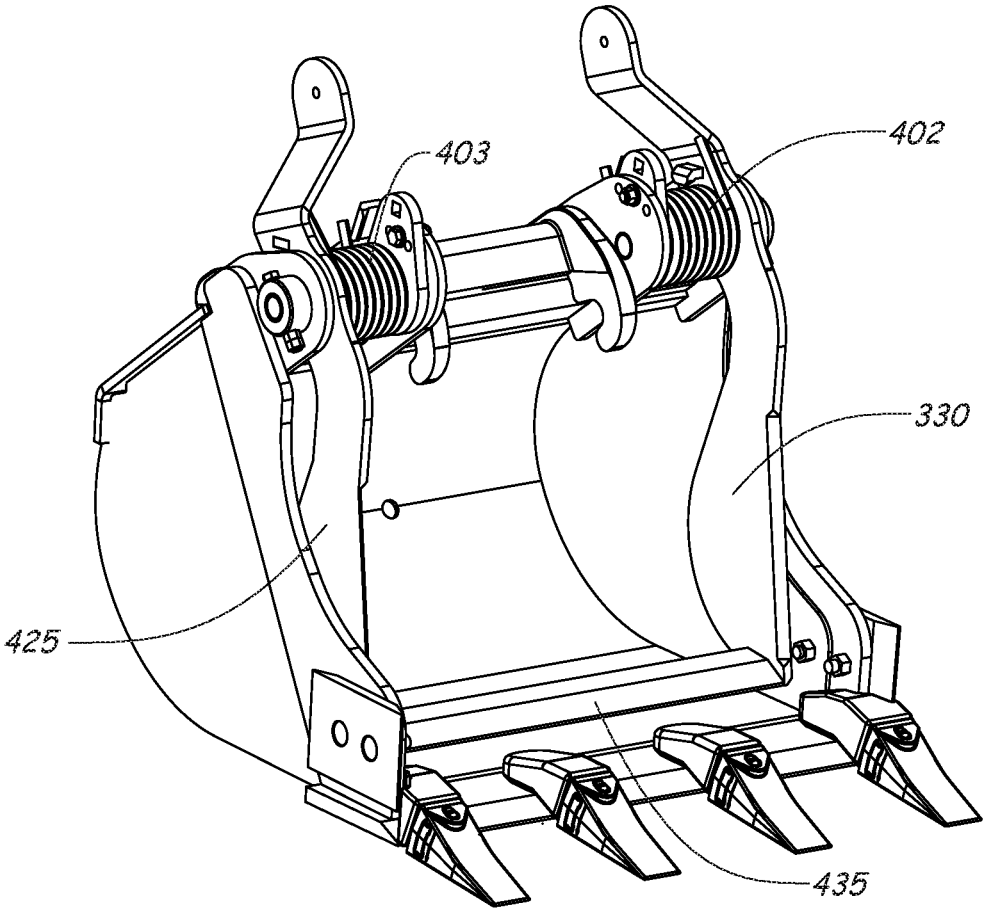

FIGS. 6-8 illustrate bucket 405 with cleanout mechanism 420 mounted therein. In each of FIGS. 6-8, the bucket 405 is removed from arm 434 and cleanout device 420 does not show the mount 450. FIG. 6 shows the arms 425 and 430 (and cross-member 435) in the first position, which FIG. 8 shows the arms 425 and 430 in the second position. FIG. 7 shows a view from a front of the bucket, showing the arms 425 and 430 and the cross-member 435 positioned within the bucket 405. When the mount 450 is removed, apertures 417 and 419, for receiving the linking mechanisms 456 and 458 are shown.

In some embodiments, through portions of the rotational movement of bucket 405 relative to arm 434, linking mechanisms 456 and 458 (shown in FIG. 4) do not apply forces to arms 430 and 425. For example, when bucket 405 is pivoted or rolled forward during a digging movement, the cables, chains or other linking mechanisms are not taut or tensioned through at least a portion of the bucket movement, and allow arms 430 and 425 to be maintained in the first position under the influence of bias forces from bias mechanisms 442 and 444. This same conditional state can be maintained through at least a portion of a rollback movement of the bucket.

When bucket 405 has been rolled back by actuator 433D to the point of linking mechanisms 456 and 458 becoming taut and under tension, linking mechanisms 454 and 456 apply forces to arm portions 432 and 427 that counteract bias forces from bias mechanisms 442 and 444. When the bias forces are overcome by further rollback movement of bucket 405 relative to arm 434, arms 430 and 425 are pivoted in the opposite direction as movement of bucket 405. This causes cross-member 435 to move from the first position (shown in FIG. 6) inside the bucket toward the second position (shown in FIGS. 4, 7 and 8) near a front edge of the bucket. The further the rollback movement of the bucket 405, the further the movement of cross-member 435 in the opposite direction until the cross-member reaches the second position. Along the movement path of cross-member 435, material within bucket 405 is pushed, cut, or otherwise moved to aid in dumping the material from the bucket.

FIGS. 9-11 illustrate arm 434 and bucket 405, but with the linking mechanisms 456 and 458 of cleanout device 420 utilizing chains instead of cables. As shown in a partially rolled forward position of bucket 405 in FIG. 9, the chains of linking mechanisms 456 and 458 are not under tension. Thus, the cleanout device 420 is maintained or urged by the bias forces of first and second spring loaded bracket assemblies 442 and 444, with cross-member 435 (not visible in FIG. 9) in its first position within the bucket. In FIG. 10, actuator 433D has rolled bucket 405 partially back and the chains of linking mechanisms 456 and 458 are nearing a state of tension. Under the influence of the bias forces from first and second spring loaded bracket assemblies 442 and 444, cross-member 435 has traveled with the bucket 405 during the partial rollback movement and has been maintained in the first position. In FIG. 11, actuator 433D has rolled bucket 405 fully back and the chains of linking mechanisms 456 and 458 are under a state of tension. Once under tension during the rollback movement of the bucket to the position shown in FIG. 11, the chains of linking mechanisms 456 and 468 apply counteracting forces to the arms of cleanout device 420, causing rotation of the arms and cross-member in the opposite direction of the bucket toward the second position shown in FIG. 11. In some instances, such as when a bucket has excessive dirt or debris lodged therein the biasing mechanism (i.e. first and second spring loaded bracket assemblies 442 and 444) is incapable of returning to the first position by itself when the bucket is rolled forward enough that the chains are not under tension. In the embodiments shown, as the bucket is fully rolled forward, the arrangement of the cleanout device 420 is configured so that the chains or cables or linking mechanisms 456 and 458 engage the arms 427 and 432 to assist the biasing mechanism to return the cleanout device back to the first position.

A benefit of cleanout device 420 is that a separate powered actuator is not required to cause material clearing movement of the cleanout device. The range of movement of the cross-member can be configured by design for various buckets, as can the position of rollback movement of the bucket at which the cleanout device begins to move relative to the bucket. Cleanout device 420 provides numerous other benefits as well.

Figure 16:
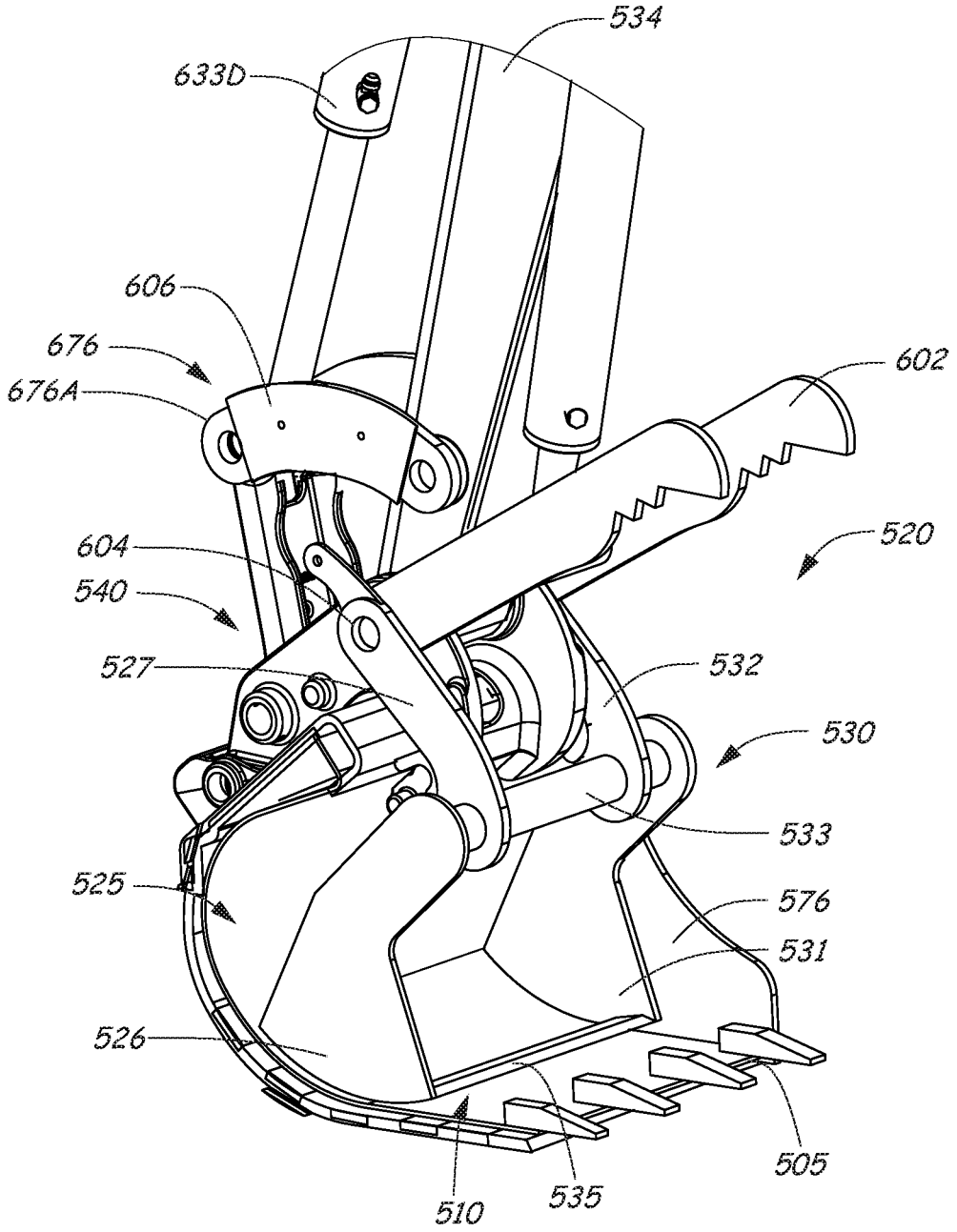
FIG. 16 is a diagrammatic perspective view of an excavator arm and bucket including a bucket cleanout device in accordance with another exemplary embodiments.
Figure 17:
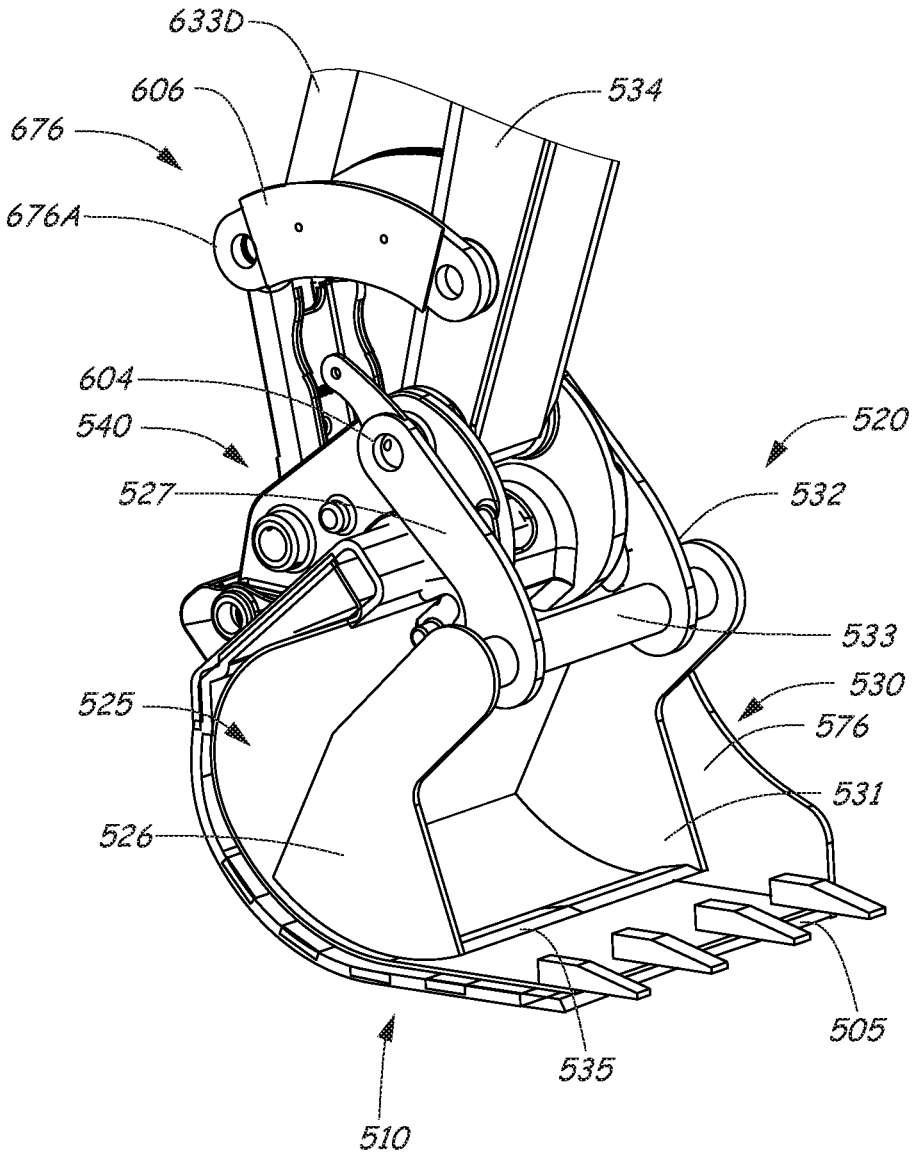
FIG. 17 is a diagrammatic perspective view of bucket cleanout device shown in FIG. 16 configured for a smaller sized bucket.

Referring now to FIGS. 16-19, shown is a cleanout mechanism or device 520 in accordance with another example embodiment that is configured to aid in the removal of material from bucket 505 of a power machine during a material dumping movement of the bucket. FIGS. 16 and 17 illustrate bucket 505 with a first sidewall 574 (shown in FIG. 18) removed to better illustrate features of cleanout mechanism 520. FIG. 16 illustrates bucket cleanout mechanism 520 used in a 24-inch bucket, while FIG. 17 illustrates bucket cleanout mechanism 520 used in a smaller 12-inch bucket.

Bucket cleanout device 520 includes a cleanout arm assembly 510 that is partially positioned within the bucket 505. The bucket cleanout device 520 includes a pivot attachment mechanism 540 through which the cleanout arm assembly 510 is pivotally mounted to a first support structure, such as power machine arm 534, bucket 505, or an implement carrier for a thumb implement 602. Pivot attachment mechanism 540 is configure to pivotally mount the cleanout arm assembly 510 to the first support structure such that the cleanout arm assembly pivots to move within bucket 505.

Unlike cleanout mechanism 420, in cleanout mechanism 520 the attachment mechanism 540 does not include spring loaded bracket assemblies in exemplary embodiments. Instead, attachment mechanism 540 includes a pin 604 which pivotally attaches the cleanout mechanism to the first support structure, which for example is arm 534 of the power machine or an implement carrier which attaches thumb implement 602 to the arm 534. In the illustrated embodiment, pin 604 extends through and pivotally mounts both of cleanout mechanism 520 and thumb implement 602.

The bucket cleanout device 520 also includes a mount 550 (shown in FIGS. 18 and 19) coupled to a second support structure and configured to couple the cleanout arm assembly 510 to the second support structure. The second support structure can be a structure coupled to arm 534 of the power machine, and in one embodiment is a link 676A, of a link assembly 676, pivotally mounted to arm 534 and to an implement carrier actuator 633D to roll the bucket forward and backward relative to arm 534 of the power machine. The link assembly 676 aids in controlling tilt functions of bucket 505 with actuator 633D. In some exemplary embodiments, a link mechanism mounting plate 606 is secured to first link 676A and configured to attach a link mechanism 556 (shown in FIGS. 18 and 19 as a chain in one embodiment) to the first link 676A. The other end of link mechanism 556 is attached to the cleanout arm assembly 510, for example using a link mechanism attachment tab 690. The cleanout arm assembly 510 being coupled to the second support structure by the mount 550 causes the cleanout arm assembly to move relative to the bucket 505 between a first position and a second position when the bucket is moved relative to an arm 534 of the power machine to thereby aid in removal of material from the bucket.

Similar to cleanout arm assembly 410, cleanout arm assembly 510 includes first and second cleanout arms 525 and 530 disposed adjacent to opposite side walls 574 and 576 of bucket 505 and configured to cut through material in the bucket adjacent to the sidewalls. However, the shape and functionality of the arms 525 and 530 differ somewhat from corresponding arms 425 and 430 discussed above, as arms 525 and 530 do not pivot about a middle portion. A cleanout blade or cross-member 535 extends between distal ends of arms 525 and 530 and is attached to each or integrally formed with the arms such that cross-member 535 spans the width of the bucket 405. Cross-member 535 is also configured to cut or scrape material from the bucket.

Similar to arms 425 and 430 discussed above, each of the arms 525 and 530 has a first arm segment or portion 526 and 531, respectively, and a second arm segment or portion 527 and 532. However, as mentioned, arms 525 and 530 do not pivot about a middle point between the arm portions, and therefore do not include pivot attachment features between the first and second arm portions. Instead first and second arm portions 526 and 527 of first arm 525 can be separate pieces, as can first and second arm portions 531 and 532 of second arm 530. A middle support member 533 extending between arms 525 and 530 can couple the first and second arm portions of each arm together to increase strength and stability of the cleanout arm assembly. Further, using different length, and optionally different style, middle support members 533 and cross-members 535 allows bucket cleanout mechanism 520 to be used in different sized buckets. For example, FIG. 16 illustrates bucket cleanout mechanism 520 used in a 24-inch bucket, while FIG. 17 illustrates bucket cleanout mechanism used in a 12-inch bucket.

The arm portions 526, 527, 531 and 532 can have different shapes and configurations in various embodiments. For example, the arm portions 526 and 531 are advantageously shaped with wide cutting surfaces and rounded edges configured to engage the inside surfaces of the bucket 505. Similarly, blade or cross-member 535 can have various shapes to optimize cutting surfaces for scraping debris from bucket 505 as the bottom of the cross-member follows the bucket contour. Further, to accommodate buckets with a flat portion where the constant radius movement of the cross-member may not be able to maintain contact with the bucket, the blade or cross-member can utilize other configurations to scrape the flat portion of the bucket. For example, the cross-member can be a pivoting or rotating member biased to maintain contact with non-arcuate portions of the bucket in order to cause more material to be removed from the bucket.

Figure 18:
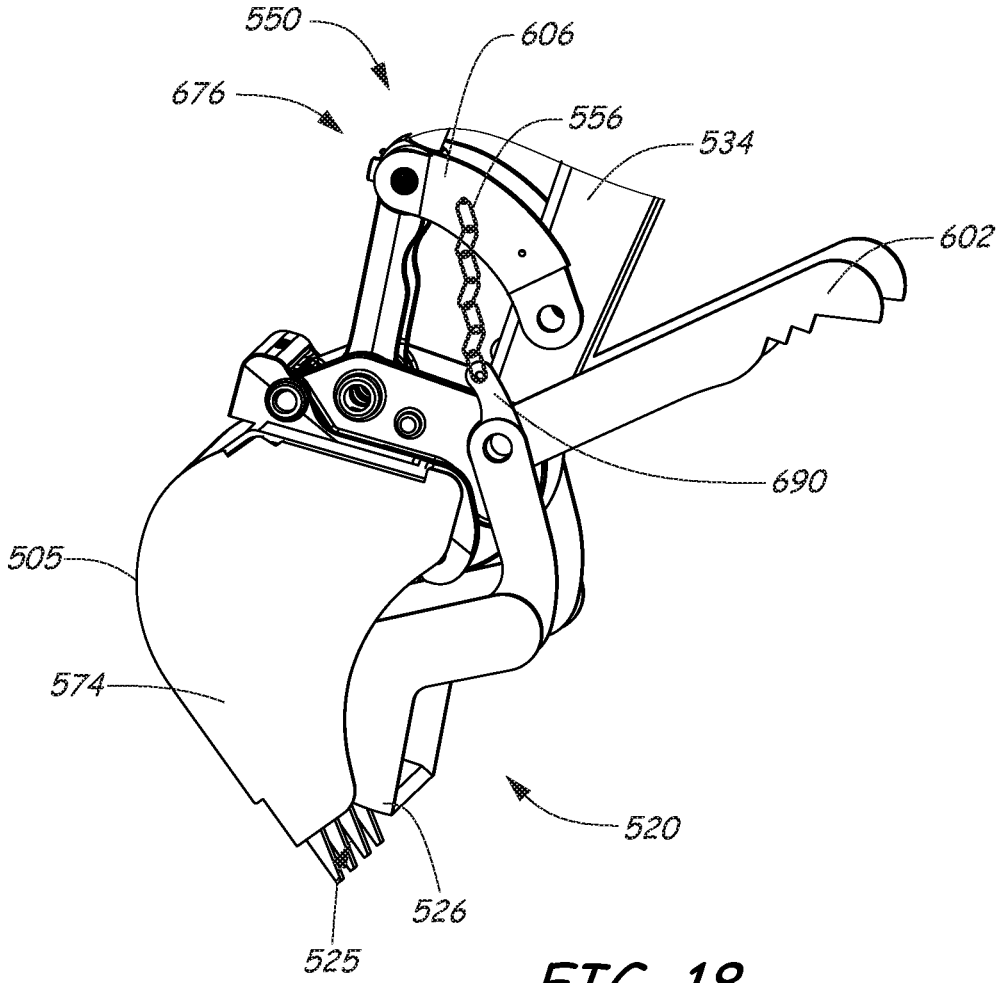
FIGS. 18 and 19 are diagrammatic perspective views of the excavator arm, bucket and bucket cleanout device shown in FIG. 16, with the bucket cleanout device moved from a first position within the bucket toward a second position to aid in removal of material from the bucket.
Figure 19:
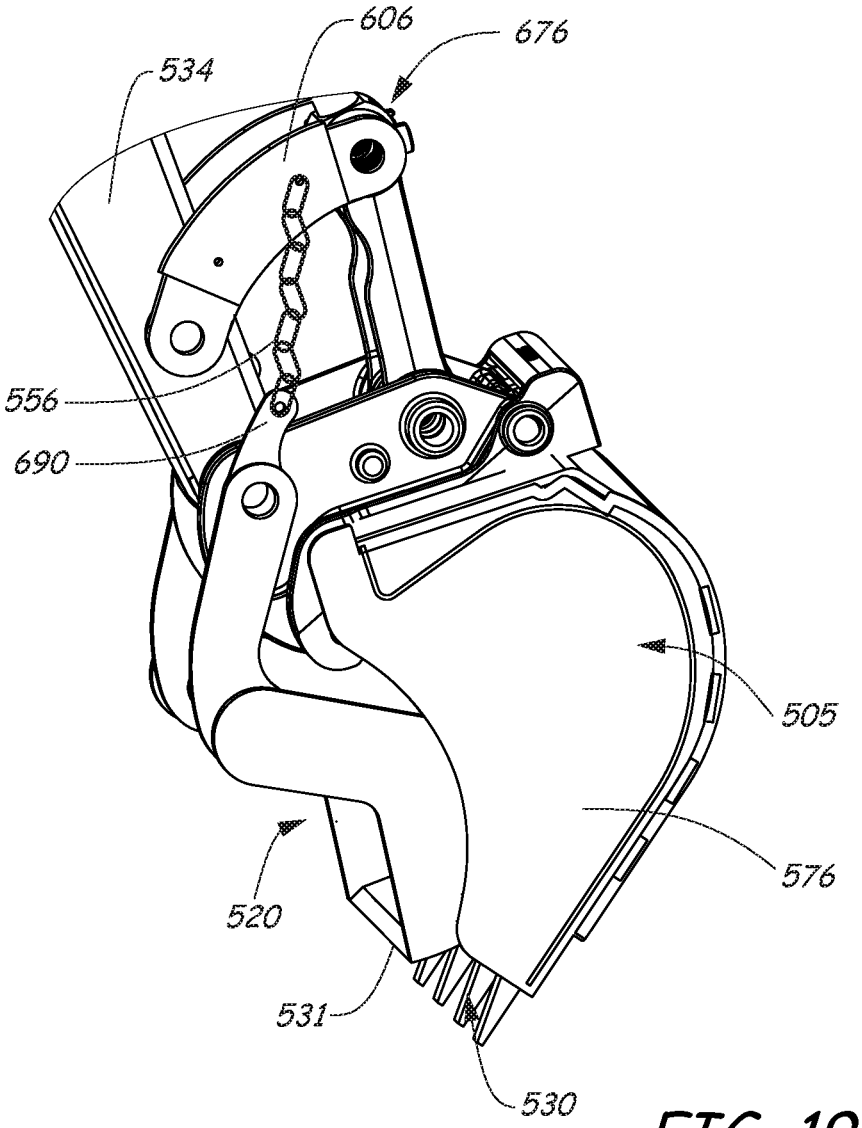

FIGS. 18 and 19 illustrate mount 550 of bucket cleanout mechanism 520. Mount 550 couples the cleanout arm assembly 510 of cleanout mechanism 520 to a second support structure, which in the illustrated embodiment is a link of link assembly 676. As discussed, a mounting plate 606 can be welded or otherwise secured to the link assembly to facilitate attachment of mount 550 to the link assembly. However, in exemplary embodiments, no welding on or modification to the arm 534 of the power machine is required. Mount 550 of cleanout device 520 further includes linking mechanisms 556 coupled between tab 690 on first arm 525 and mounting plate 606. Mount 550 can also include a mounting plate 606 and a linking mechanism 556 on the opposite side of the lift arm and coupled to second arm 530, though this is not required in all embodiments. In exemplary embodiments, linking mechanism(s) 556 can be chains (as shown in FIGS. 18 and 19), cables, or other types of linkages or linking mechanisms.

FIGS. 16 and 17 illustrate the cleanout arm assembly 510 in a first position within the bucket 505 as the bucket is in an at least partially rolled forward position. This corresponds to the position of bucket 505 and cleanout arm assembly 510 when digging or carrying material. FIG. 18 illustrates the bucket in a position which is rolled back from the position shown in FIGS. 16 and 17 such that linking mechanism 556 is beginning to come under tension, causing movement of cleanout arm assembly 510 toward a second position. FIG. 19 illustrates the bucket 505 in a fully rolled back position used to dump material from the bucket. As seen in FIG. 19, in this bucket position, linking mechanism 556 is fully tensioned, causing cleanout arm assembly 510 to rotate to the second position near a front edge of the bucket. Along the movement path of cross-member 535 and first and second arms 525 and 530, material within bucket 505 is pushed, cut, or otherwise moved to aid in dumping the material from the bucket.

Although the present invention has been described with reference to preferred embodiments, workers skilled in the art will recognize that changes may be made in form and detail without departing from the scope of the discussion.

What is claimed is:

1. A bucket cleanout apparatus configured to aid in removal of material from a bucket attachable to an arm of a power machine, the bucket cleanout apparatus comprising:

a cleanout arm assembly configured to be at least partially positioned within the bucket, the cleanout arm assembly comprising a first arm, a second arm, and a cross-member extending between the first arm and the second arm, and wherein each of the first arm and the second arm of the cleanout arm assembly further comprises a first arm portion and a second arm portion;

a pivot attachment mechanism configured to mount the cleanout arm assembly to a first support structure attached to the arm of the power machine and allow the cleanout arm assembly to pivot within the bucket;

a mount coupled to a second support structure and configured to couple the cleanout arm assembly to the second support structure, wherein the cleanout arm assembly being coupled to the second support structure by the mount causes the cleanout arm assembly to move relative to the bucket between a first position and a second position when the bucket is moved relative to the arm of the power machine to thereby aid in removal of material from the bucket, wherein the mount further comprises a first linking mechanism configured to couple the second arm portion of the first arm to the second support structure of the power machine, wherein in a first bucket position the first linking mechanism is not under tension, and wherein rollback movement of the bucket toward a second bucket position places the first linking mechanism under tension such that further roll back movement of the bucket causes the first linking mechanism to move the cleanout arm assembly to the second position relative to the bucket.

2. The bucket cleanout apparatus of claim 1, wherein at least portions of the first arm and the second arm of the cleanout arm assembly are configured to be respectively disposed adjacent to opposite side walls of the bucket.

3. The bucket cleanout apparatus of claim 2, wherein the cross-member of the cleanout arm assembly extends between the first arm and the second arm substantially across a width of the bucket.

4. The bucket cleanout apparatus of claim 1, wherein the first support structure is the bucket and wherein each of the first arm and the second arm includes a pivot attachment feature positioned between the first and second arm portions, the pivot attachment features of the first and second arms configured to pivotally mount the cleanout arm assembly to the bucket with the pivot attachment mechanism.

5. The bucket cleanout apparatus of claim 4, wherein the pivot attachment mechanism comprises first and second spring-loaded bracket assemblies each configured to be positioned on sides of an implement carrier to which the bucket is attached and to apply bias forces to the cleanout arm assembly.

6. The bucket cleanout apparatus of claim 5, wherein the mount further comprises a second linking mechanism configured to couple the second arm portion of the second arm to the second support structure, wherein in the first bucket position the first and second linking mechanisms are not under tension and the first and second spring loaded bracket assemblies maintain the cleanout arm assembly in the first position relative to the bucket, and wherein rollback movement of the bucket toward the second bucket position places the first and second linking mechanisms under tension such that further roll back movement of the bucket causes the first and second linking mechanisms to apply counteracting forces to the cleanout arm assembly to overcome the bias forces applied by the first and second spring-loaded bracket assemblies and thereby move the cleanout arm assembly to the second position relative to the bucket.

7. The bucket cleanout apparatus of claim 1, wherein distal ends of the second arm portions of each of the first and second arms are pivotally attached to the first support structure by the pivot attachment mechanism.

8. The bucket cleanout apparatus of claim 7, wherein the first arm portions of each of the first and second arms of the cleanout arm assembly are configured and shaped to be respectively disposed in the bucket adjacent to opposite side walls of the bucket.

9. The bucket cleanout apparatus of claim 8, and further comprising a middle support member extending between the first and second arms and coupling the first and second arm portions of each arm.

10. A power machine, comprising:

a power machine arm;

a bucket;

an implement carrier coupling the bucket to the power machine arm;

a cleanout arm assembly at least partially positioned within the bucket, wherein the cleanout arm assembly comprises a first arm, a second arm, and a cross-member extending between the first arm and the second arm, wherein at least portions of the first arm and the second arm of the cleanout arm assembly are respectively disposed adjacent to opposite side walls of the bucket, and wherein each of the first arm and the second arm of the cleanout arm assembly further comprises a first arm portion and a second arm portion coupled to the first arm portion;

a pivot attachment mechanism mounting the cleanout arm assembly to a first support structure and allowing the cleanout arm assembly to pivot to move within the bucket; and a mount coupled to a second support structure and configured to couple the cleanout arm assembly to the second support structure, wherein the cleanout arm assembly being coupled to the second support structure by the mount causes the cleanout arm assembly to move relative to the bucket between a first position and a second position when the bucket is moved relative to the arm of the power machine to thereby aid in removal of material from the bucket, wherein the mount further comprises a first linking mechanism configured to couple the second arm portion of the first arm to the second support structure of the power machine, wherein in a first bucket position the first linking mechanisms is not under tension, and wherein rollback movement of the bucket toward a second bucket position places the first linking mechanism under tension such that further roll back movement of the bucket causes the first linking mechanism to move the cleanout arm assembly to the second position relative to the bucket.

11. The power machine of claim 10, wherein the cross-member of the cleanout arm assembly extends between distal ends of the first arm and the second arm substantially across a width of the bucket.

12. The power machine of claim 10, wherein each of the first arm and the second arm includes a pivot attachment feature positioned between the first and second arm portions, the pivot attachment features of the first and second arms pivotally mounting the cleanout arm assembly to the bucket with the pivot attachment mechanism.

13. The power machine of claim 10, wherein the first arm portions of each of the first and second arms of the cleanout arm assembly are respectively disposed in the bucket adjacent to the opposite side walls of the bucket.

14. The power machine of claim 13, wherein the pivot attachment mechanism comprises first and second spring-loaded bracket assemblies each positioned on sides of the implement carrier and configured to apply bias forces to the cleanout arm assembly to maintain the cleanout arm assembly in the first position relative to the bucket.

15. The power machine of claim 14, wherein the mount further comprises a second linking mechanism coupling the second arm portion of the second arm to the arm of the power machine, wherein in the first bucket position the first and second linking mechanisms are not under tension and the first and second spring loaded bracket assemblies maintain the cleanout arm assembly in the first position relative to the bucket, and wherein rollback movement of the bucket toward the second bucket position places the first and second linking mechanisms under tension such that further roll back movement of the bucket causes the first and second linking mechanisms to apply counteracting forces to the cleanout arm assembly to overcome the bias forces applied by the first and second spring-loaded bracket assemblies and thereby move the cleanout arm assembly to the second position relative to the bucket.

16. The power machine of claim 13, wherein distal ends of the second arm portion of each of the first and second arms are pivotally attached to the first support structure by the pivot attachment mechanism.

17. The bucket cleanout apparatus of claim 16, and further comprising a middle support member extending between the first and second arms and coupling the first and second arm portions of each of the first and second arms.

* * * * *